United States Patent [19]

Parkinson

[11] Patent Number: 5,056,603

[45] Date of Patent: Oct. 15, 1991

[54] FIRE RESISTANT CONTAINER HAVING BOTH ACTIVE AND PASSIVE PROTECTION

[75] Inventor: William R. Parkinson, Thomson, Ga.

[73] Assignee: W.R. Parkinson Co., Inc., Thomson, Ga.

[21] Appl. No.: 489,292

[22] Filed: Mar. 5, 1990

[51] Int. Cl.[5] ..... A62C 35/02

[52] U.S. Cl. ..... 169/48; 169/26; 169/54; 169/57

[58] Field of Search ..... 169/48, 49, 26, 54, 169/56, 57

[56] References Cited

U.S. PATENT DOCUMENTS

| | | | |
|---|---|---|---|
| 774,353 | 11/1904 | Galvin | 169/26 |
| 1,032,351 | 7/1912 | Easton | 169/26 |
| 1,325,769 | 12/1919 | Welch | 169/26 |
| 1,832,056 | 11/1931 | Spencer | 169/26 |
| 3,119,452 | 1/1964 | Sammis | 169/54 X |
| 3,292,748 | 6/1964 | Rifkin . | |
| 3,489,223 | 1/1970 | Bundo, Sr. . | |
| 3,536,139 | 10/1970 | Berti et al. | 169/26 |
| 3,637,000 | 1/1972 | Walger et al. . | |
| 3,796,267 | 3/1974 | Hunter et al. | 169/57 |
| 4,013,127 | 3/1977 | Tenney et al. | 169/57 |
| 4,411,318 | 10/1983 | Zeischegg et al. | 169/26 |

FOREIGN PATENT DOCUMENTS

| | | | |
|---|---|---|---|
| 2717497 | 10/1978 | Fed. Rep. of Germany | 169/54 |
| 3027861 | 2/1982 | Fed. Rep. of Germany | 169/26 |
| 3336623 | 5/1985 | Fed. Rep. of Germany | 169/54 |
| 2369811 | 7/1978 | France | 169/48 |
| 2072011 | 9/1981 | United Kingdom | 169/54 |

*Primary Examiner*—Margaret A. Focarino
*Assistant Examiner*—James M. Kannofsky
*Attorney, Agent, or Firm*—Sughrue, Mion, Zinn, Macpeak & Seas

[57] ABSTRACT

A fire-resistant container such as a courier bag or the like which provides both active and passive protection to its contents to thereby obtain a high degree of fire protection over a long period of time. Passive protection is provided by insulating walls, while active protection is obtained by disposing inside the bag a gas cylinder containing a charge of halogenated hydrocarbon. The gas cylinder is closed with a solder plug whose melting temperature is chosen in accordance with the type of material to be protected.

7 Claims, 2 Drawing Sheets

FIRE RESISTANT CONTAINER HAVING BOTH ACTIVE AND PASSIVE PROTECTION

BACKGROUND OF THE INVENTION

The present invention relates to a fire-resistant container such as a courier bag for bank documents, currency, computer disks or tapes or the like which is capable of protecting the contents thereof from fires and other high temperature conditions.

Fire-resistant courier bags providing only passive protection are known in the art, examples of which are disclosed in U.S. Pats. Nos. 3,292,748 and 3,637,000. These bags generally employ one or more layers of a flexible insulating material with a protective cloth layer on the outside surface of the bag. While such bags are capable of providing some degree of protection to paper documents against fire, the time period over which such bags can offer full protection is limited. Also, such bags are generally incapable of providing any reasonable fire protection to highly temperature sensitive media such as computer disks and tapes and photographic materials, which can be damaged by sustained temperatures as low as 140° F.

It is thus an object of the present invention to provide a fire-resistant container which overcomes these drawbacks and provides a high degree of fire protection for a long period of time.

It is a further object of the invention to provide a fire-resistant container which is capable of providing good protection for magnetic media and photographic materials.

SUMMARY OF THE INVENTION

These, as well as other objects of the invention are met by a fire-resistant container comprising a plurality of walls defining an interior space, the walls being formed of a heat insulating, fire-resistant material, closure means for closing the interior space in a substantially gas-tight manner, and means for releasing a halogenated hydrocarbon gas into said interior space when a temperature therein exceeds a predetermined temperature.

DESCRIPTION OF THE PREFERRED EMBODIMENTS

A first embodiment of a fire-resistant courier bag of the invention will be described with reference to FIGS. 1 to 4 of the attached drawings.

Figure 1:
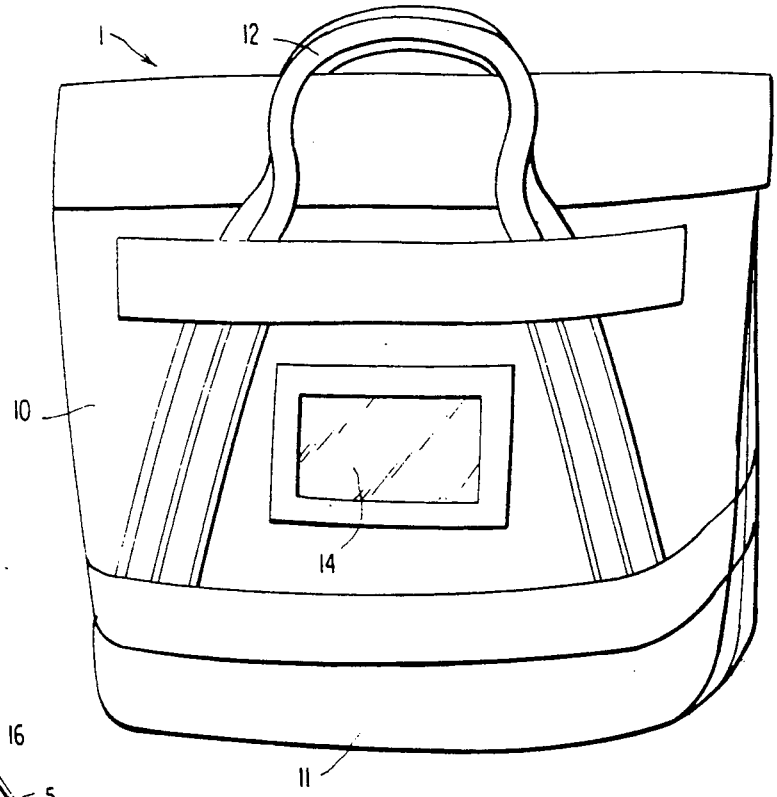
FIG. 1 shows a side view of a fire-resistant courier bag constructed in accordance with the teachings of the present invention.
Figure 2:
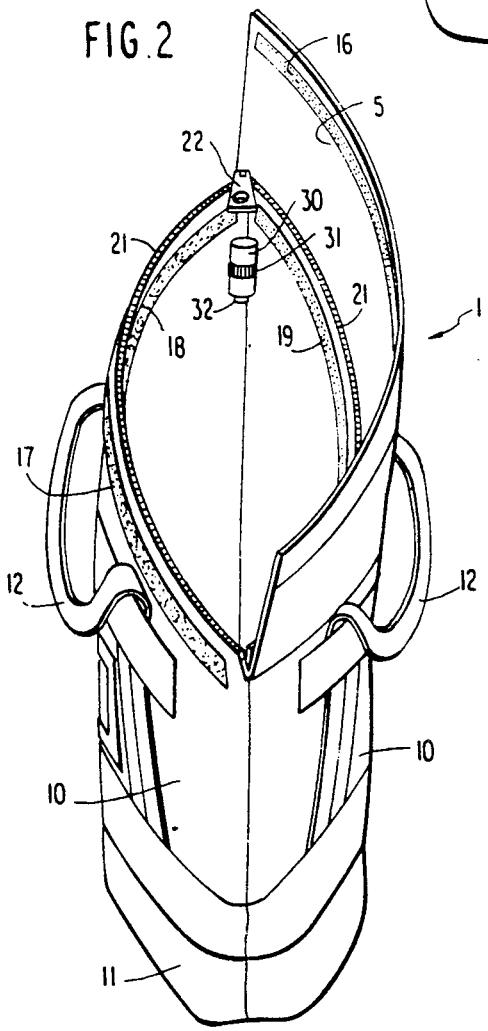
FIG. 2 is a top perspective view of the courier bag of FIG. 1 showing the interior of the bag.
Figure 4:
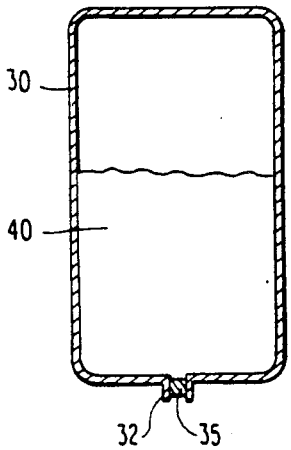
FIG. 4 shows a longitudinal cut-away view of a gas cylinder used in the courier bag of FIG. 1.
Figure 3:
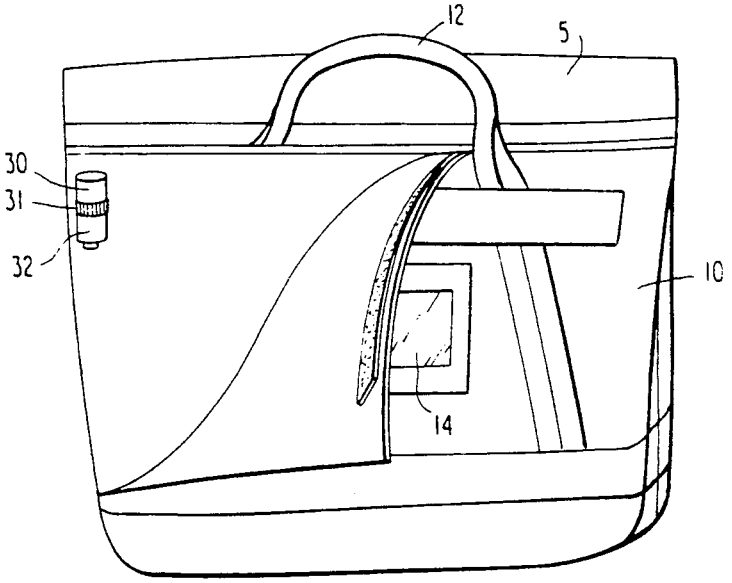
FIG. 3 is a side view of the courier bag of FIG. 1 is a portion of a side wall thereof peeled away.

As shown in FIGS. 1 to 3, the inventive courier bag 1 has two opposed side walls 10, a bottom portion 11, and a fold-over top flap 5. Each of these is composed of a three-layer construction. The outer layer is formed of a mechanically rugged, water resistant cloth-like material, an acceptable example of which is the fabric produced by E.I. DuPont and sold under the trade name "Cordura". The inner layer is preferably composed of a double layer of a ceramic-fiber blanket material. A suitable example is two ¼ inch layers of a ceramic-fiber blanket products containing 47% alumina and 53% silica produced by Thermal Ceramics Inc. and sold under the trade name "Kaowool". The inner layer is preferably formed of an aramid material in a weight of 17 oz. per square yard which has an aluminized layer 2 mils in thickness on the surface disposed towards the outside surface of the bag.

The outer surface of the bag may be provided with handles 12 and an identification window 14 as desired.

The flap 5 is folded over the top of the bag when the bag is closed and in use. The flap 5 is provided with a press-type fastener strip 16 which mates with a corresponding fastener strip 17 attached to the outer surface of the bag to hold the flap 5 firmly closed. The fastener strips 16 and 17 may be of the hook-and-loop (Velcro) type, for instance. Similar fastener strips 18 and 19 are provided on the inside surface of the opposed walls 10 to add further closing force to the upper end of the bag and to restrict the egress or ingress of air and gases contained within the bag. Also, for security a zipper 21 is disposed along the upper rim of the walls 10. The combination of these three closure means, namely, the fastener strips 16 and 17, the fastener strips 18 and 19, and the zipper 21, provides a good gas seal which prevent air from entering and leaving the interior of the bag. The zipper closure 22 may be provided with lock to allow the bag to be closed with a key.

A gas cylinder 30 is mounted inside the bag 1, secured along the juncture between the walls 10 by a strap or loop 31. As shown in more detail in FIG. 4, the cylinder 30 is partially filled with a fire and heat retardant fluid 40, which is in liquid form in its pressurized condition within the cylinder 30. The cylinder 30 has an outlet 32 which is closed with a solder plug 32. The melting temperature of the solder material of the plug 32 is chosen in accordance with the type of document to be protected. For example, for paper, which has a combustion temperature of approximately 451° F., a solder having a melting temperature on the order of 400° F. is suitable, whereas for magnetic media, which can be damaged by sustained temperatures of about 140° F., a solder material having a melting temperature of about 125° F. may be used.

The heat retardant fluid 40 is preferably a halogenated hydrocarbon. These materials are preferred because they provide three distinct fire- and heat-retarding effects. First, a cooling effect is produced when the solder plug 32 breaks and opens the cylinder 30. Secondly, the gas thereby released into the interior of the bag 1 provides a smothering effect against flaming. Thirdly, the gas causes a chemical breakup which inhibits the combustion process. Also, once dispersed within the bag 1, the gas will stay mixed with the air initially present within the bag and render the atmosphere within the bag inert.

Particularly preferred among the halogenated hydrocarbons are bromochlorodifluoromethane ($CBrClF_2$) and dibromodifluoromethane ($CBr_2F_2$). Of these two, the former is particularly preferred for safety reasons.

The amount of halogenated hydrocarbon loaded in the cylinder 30 may be about 1 to 2 oz. for a bag of a total volume of 1.5 cubic feet. The cylinder 30 should have a total capacity of about twice the amount of halogenated hydrocarbon loaded therein to allow for expansion without danger of rupture.

In order to retain the gas released from the cylinder 30 for a sufficient time to prevent most damage which could be caused in a fire, the bag 1 should be sufficiently gas tight to retain most of the increased pressure caused by the release of the gas for a period of about 15 to 20 minutes.

With the above-described construction, the insulating walls 10 of the bag provide passive protection to the contents of the bag so as to significantly slow the temperature rise inside the bag in the event of fire. As to active protection, when the temperature reaches a critical level, the gas cylinder 30 opens, expelling the halogenated hydrocarbon gas, and thereby instantly cooling the interior of the bag and preventing combustion of its contents. Thus, with the courier bag of the invention, the duration of fire protection is significantly extended over that which can be obtained with conventional fire-resistant containers.

Figure 5:
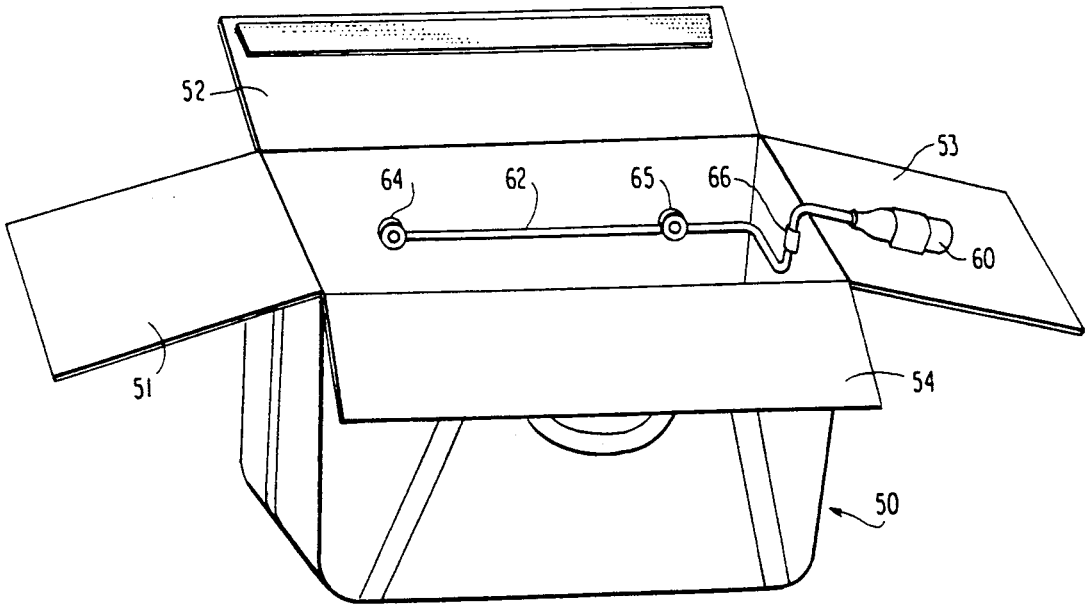
FIG. 5 depicts a perspective view of an alternative embodiment of a fire resistant container of the invention.

A second embodiment of the invention is shown in FIG. 5. This embodiment takes the form of a rectangularly shaped container 50 suitable for receiving stacks of bank checks or the like. The upper end of the container 50 is closed by four flaps 51–54, which have hook-and-loop type closures similar to those of the first embodiment described above. The walls, bottom and flaps of the container are made of the same types of materials as in the case of the first embodiment.

A gas cylinder 60 is secured to one (53) of the flaps 51–54. A tube or pipe 62 extends from the outlet of the cylinder 60 along the inner surfaces of two sides of the container, secured as necessary by fasteners 66 of any desired design. Nozzles 64 and 65 are connected to the pipe 62. Each of the nozzles 64 and 65 is plugged with a solder plug of similar constitution to the plug 35 in the first embodiment. A similar halogenated hydrocarbon is filled in the cylinder 50. The operation of the second embodiment is generally the same as in the first embodiment.

This completes the preferred embodiments of the invention. Although preferred embodiments have been described, it is believed that numerous modifications and alterations thereto would be apparent to one of ordinary skill in the art without departing from the spirit and scope of the invention.

What is claimed is:

1. A fire-resistant container comprising:

a plurality of walls defining an interior space, said walls being formed of a heat-insulating, fire-resistant material, said walls comprising an outer layer of a mechanically rugged water resistant material, a middle layer of a heat insulating material, and an inner layer of an aramid fiber material having an aluminized layer on a surface thereof disposed towards an outer surface of said container;

closure means for closing said interior space in a substantially gas-tight manner; and means for releasing a halogenated hydrocarbon gas into said interior space when a temperature therein exceeds a predetermined temperature.

2. The fire-resistant container of claim 1, wherein said halogenated hydrocarbon gas is selected from among the group consisting of bromochlorodifluoromethane and dibromodifluoromethane.

3. The fire-resistant container of claim 2, wherein said means for releasing said halogenated hydrocarbon comprises a gas cylinder having a solder plug.

4. The fire-resistant container of claim 3, wherein said solder plug has a melting temperature selected in accordance with a contents of said container.

5. The fire-resistant container of claim 3, further comprising a pipe extending from said cylinder and at least one nozzle connected to said pipe, said solder plug being disposed in said nozzle.

6. The fire-resistant container of claim 1, wherein said middle layer comprises a plurality of layers of a ceramic fiber blanket.

7. A fire-resistant container comprising:

a plurality of walls defining an interior space, said walls being formed of a heat-insulating, fire-resistant material;

closure means for closing said interior space in a substantially gas-type manner, said closure means comprising a flap for covering an open end of said container, a first strip of a hook-and-loop fastener extending along an inner edge of said flap and a mating second strip of a hook-and-loop fastener extending along an outer surface of one of said walls, a zipper located along upper edges of said walls under said flap when said flap is in a closed position, and third and fourth mating strips of a hook-and-loop fastener extending along inner surfaces of said upper edges of said walls below said zipper; and means for releasing a halogenated hydrocarbon gas into said interior space when a temperature therein exceeds a predetermined temperature.

* * * * *